US012359815B2

(12) United States Patent
Lim et al.

(10) Patent No.: US 12,359,815 B2
(45) Date of Patent: Jul. 15, 2025

(54) COMBUSTOR NOZZLE, COMBUSTOR, AND GAS TURBINE INCLUDING SAME

(71) Applicant: DOOSAN ENERBILITY CO., LTD., Changwon-si (KR)

(72) Inventors: Joong Hyun Lim, Changwon-si (KR); Young Gun Go, Yongin-si (KR); Ho Keun Kim, Daejeon (KR); Eun Seong Cho, Busan (KR)

(73) Assignee: Doosan Enerbility Co., Ltd., Changwon-si (KR)

( * ) Notice: Subject to any disclaimer, the term of this patent is extended or adjusted under 35 U.S.C. 154(b) by 0 days.

(21) Appl. No.: 18/947,604

(22) Filed: Nov. 14, 2024

(65) Prior Publication Data

US 2025/0198625 A1 Jun. 19, 2025

(30) Foreign Application Priority Data

Dec. 15, 2023 (KR) ..... 10-2023-0183668

(51) Int. Cl.
*F23R 3/28* (2006.01)

(52) U.S. Cl.
CPC ..... *F23R 3/286* (2013.01)

(58) Field of Classification Search
CPC .. F23R 3/28; F23R 3/283; F23R 3/286; F23R 3/34; F23R 3/343; F23R 3/346; F23R 3/36
See application file for complete search history.

(56) References Cited

U.S. PATENT DOCUMENTS 9,243,803 B2 * 1/2016 Berry ..... F23R 3/283
2010/0024426 A1 2/2010 Varatharajan et al.
2013/0086912 A1 * 4/2013 Berry ..... F23R 3/286 239/128
2013/0318977 A1 12/2013 Berry et al.
2015/0076251 A1 * 3/2015 Berry ..... F23R 3/10 239/418
2016/0290650 A1 10/2016 Abd El-Nabi et al.
(Continued)

FOREIGN PATENT DOCUMENTS

EP 3637000 A1 4/2020
EP 4202306 A1 6/2023
(Continued)

OTHER PUBLICATIONS

Extended European Search Report for EP Application 24215294.0 mailed Apr. 23, 2025, 8 pages.

*Primary Examiner* — William H Rodriguez
(74) *Attorney, Agent, or Firm* — Shook, Hardy & Bacon L.L.P.

(57) ABSTRACT

A combustor nozzle includes a plurality of mixing tubes through which air and fuel flow, a plurality of accommodation tubes each accommodating and supporting the plurality of mixing tubes therein, a first fuel tube coupled to each accommodation tube to supply a first fuel into the accommodation tube, a second fuel tube coupled to each accommodation tube to supply a second fuel into the accommodation tube, and a fuel supply member supplying the first fuel accommodated in the accommodation tube into each mixing tube, wherein the accommodation tube has a fuel container combined with the second fuel tube to contain the second fuel therein, and an auxiliary injection member is disposed on the fuel container to inject the second fuel from the accommodation tube.

20 Claims, 8 Drawing Sheets

(56) References Cited

U.S. PATENT DOCUMENTS

| | | | | |
|---|---|---|---|---|
| 2017/0276364 | A1* | 9/2017 | Berry | F02C 7/22 |
| 2017/0299186 | A1* | 10/2017 | Berry | F02C 7/18 |
| 2018/0051632 | A1* | 2/2018 | Word | F23R 3/286 |
| 2018/0156462 | A1* | 6/2018 | Stoia | F23R 3/283 |
| 2018/0172273 | A1* | 6/2018 | Purcell | F23R 3/286 |
| 2018/0209647 | A1* | 7/2018 | Bailey | F23R 3/283 |
| 2018/0363906 | A1* | 12/2018 | Bailey | F23R 3/04 |
| 2019/0360697 | A1* | 11/2019 | Tada | F23D 14/62 |
| 2021/0102703 | A1* | 4/2021 | Tada | F02C 7/22 |
| 2022/0228741 | A1* | 7/2022 | Jeong | F23R 3/14 |
| 2023/0104922 | A1* | 4/2023 | Berry | F28F 13/12 60/730 |

FOREIGN PATENT DOCUMENTS

| | | | |
|---|---|---|---|
| JP | 2544515 | B2 | 6/1991 |
| JP | 2002-206741 | A | 7/2002 |
| JP | 2011-080743 | A | 4/2011 |
| JP | 2013-181746 | A | 9/2013 |
| JP | 2016-070551 | A | 5/2016 |
| KR | 10-1880673 | B1 | 7/2018 |
| KR | 2020-0027894 | A | 3/2020 |
| KR | 10-2382634 | B1 | 4/2022 |
| KR | 10-2459999 | B1 | 7/2022 |

* cited by examiner

COMBUSTOR NOZZLE, COMBUSTOR, AND GAS TURBINE INCLUDING SAME

CROSS REFERENCE TO RELATED APPLICATION

The present application claims priority to Korean Patent Application No. 10-2023-0183668, filed on Dec. 15, 2023, the entire contents of which are incorporated herein for all purposes by this reference.

BACKGROUND

1. Technical Field

The present disclosure relates to a combustor nozzle, a combustor, and a gas turbine and, more particularly, to a combustor nozzle using hydrogen-containing fuel, a combustor, and a gas turbine including the same.

2. Description of the Related Art

A gas turbine is a combustion engine in which a mixture of air compressed by a compressor and fuel is combusted to produce a high temperature gas, which drives a turbine. The gas turbine is used to drive electric generators, aircraft, ships, trains, or the like.

The gas turbine generally includes a compressor, a combustor, and a turbine. The compressor serves to intake external air, compress the air, and transfer the compressed air to the combustor. The compressed air compressed by the compressor has a high temperature and a high pressure. The combustor serves to mix compressed air from the compressor and fuel and combust the mixture of compressed air and fuel to produce combustion gases, which are discharged to the gas turbine. The combustion gases drive turbine blades in the turbine to produce power. The power generated through the above processes is applied to a variety of fields such as generation of electricity, driving of mechanical units, etc.

Fuel is injected through nozzles disposed in respective combustors, wherein the fuel includes gaseous fuel and liquid fuel. In recent years, in order to suppress the emission of carbon dioxide, use of hydrogen fuel or a fuel containing hydrogen is recommended.

However, since hydrogen has a high combustion rate, when such fuels are burned with a gas turbine combustor, the flame formed in the gas turbine combustor approaches and heats the structure of the gas turbine combustor, thereby degrading the reliability of the gas turbine combustor.

To solve this problem, a combustor nozzle having multiple tubes is proposed in Unexamined Korean Patent Publication No. 10-2020-0027894 and others. The nozzle with multiple tubes is efficient for combustion of hydrogen by discharging fuel at a high speed, but when hydrocarbon-based fuel such as natural gas is supplied to the multiple tubes, the fuel is injected at an excessively high speed, causing the flame to escape from the nozzle. As a result, the combustor with multiple tubes has the problem of not being able to burn a wide variety of fuels.

The foregoing is intended merely to aid in the understanding of the background of the present disclosure, and is not intended to mean that the present disclosure falls within the purview of the related art that is already known to those skilled in the art.

SUMMARY

Accordingly, the present disclosure has been made keeping in mind the above problems occurring in the related art, and an objective of the present disclosure is to provide a combustor nozzle capable of burning a variety of fuels other than hydrogen-based fuels, a combustor, and a gas turbine including the same.

An aspect of the present disclosure provides a combustor nozzle including: a plurality of mixing tubes through which air and fuel flow; a plurality of accommodation tubes each accommodating and supporting the plurality of mixing tubes therein; a first fuel tube coupled to each accommodation tube to supply a first fuel into the accommodation tube; a second fuel tube coupled to each accommodation tube to supply a second fuel into the accommodation tube; a fuel supply member supplying the first fuel accommodated in the accommodation tube into each mixing tube; wherein the accommodation tube has a fuel container combined with the second fuel tube to contain the second fuel therein, and an auxiliary injection member is disposed on the fuel container to inject the second fuel from the accommodation tube.

The auxiliary injection member may be arranged between the mixing tubes.

A mixture of air and the first fuel may be injected into the mixing tube, and only the second fuel may be injected into the auxiliary injection member.

The mixing tube may form a main flame, and the auxiliary injection member may form a fixed flame connected with the main flame to fix the main flame to the nozzle.

The auxiliary injection member may form a fixed flame connected with the plurality of main flames to fix the main flames.

The accommodation tube may include: a tip plate formed on the front side thereof; and a middle plate spaced apart from the tip plate to define a fuel container, wherein the second fuel tube is inserted into the middle plate.

The auxiliary injection member may include: a central injection tube part extending in the longitudinal direction of the accommodation tube; and a plurality of inclined injection tube parts connected to the central injection tube part to extend radially symmetrically from the central injection tube part.

The auxiliary injection member may be internally provided with a central passage and a plurality of discharge passages connected to the central passage to extend inclined to the longitudinal direction of the central passage.

Another aspect of the present disclosure provides a combustor including: a burner having a plurality of nozzles through which fuel and air are injected; and a duct assembly coupled to one side of the burner to allow the fuel and the air to be combusted therein and combustion gases to be transferred to a turbine, wherein the nozzle includes: a plurality of mixing tubes through which air and fuel flow; a plurality of accommodation tubes each accommodating and supporting the plurality of mixing tubes therein; a first fuel tube coupled to each accommodation tube to supply a first fuel into the accommodation tube; a second fuel tube coupled to each accommodation tube to supply a second fuel into the accommodation tube; a fuel supply member supplying the first fuel accommodated in the accommodation tube into each mixing tube; wherein the accommodation tube has a fuel container combined with the second fuel tube to contain the second fuel therein, and an auxiliary injection member is disposed on the fuel container to inject the second fuel from the accommodation tube.

The auxiliary injection member may be arranged between the mixing tubes.

A mixture of air and the first fuel may be injected into the mixing tube, and only the second fuel may be injected into the auxiliary injection member.

The mixing tube may form a main flame, and the auxiliary injection member may form a fixed flame connected with the main flame to fix the main flame to the nozzle.

The auxiliary injection member may form a fixed flame connected with the plurality of main flames to fix the main flames.

The accommodation tube may include: a tip plate formed on the front side thereof; and a middle plate spaced apart from the tip plate to define a fuel container, wherein the second fuel tube is inserted into the middle plate.

The auxiliary injection member may include: a central injection tube part extending in the longitudinal direction of the accommodation tube; and a plurality of inclined injection tube parts connected to the central injection tube part to extend radially symmetrically from the central injection tube part.

The auxiliary injection member may be internally provided with a central passage and a plurality of discharge passages connected to the central passage to extend inclined to the longitudinal direction of the central passage.

A further aspect of the present disclosure provides a gas turbine including: a compressor compressing an externally introduced air; a combustor mixing the compressed air from the compressor with fuel to produce a mixture and combusting the mixture; and a turbine having a plurality of turbine blades rotated by the combustion gases from the combustor, wherein the combustor includes: a burner having a plurality of nozzles through which fuel and air are injected; and a duct assembly coupled to one side of the burner to allow the fuel and the air to be combusted therein and combustion gases to be transferred to a turbine, wherein the nozzle includes: a plurality of mixing tubes through which air and fuel flow; a plurality of accommodation tubes each accommodating and supporting the plurality of mixing tubes therein; a first fuel tube coupled to each accommodation tube to supply a first fuel into the accommodation tube; a second fuel tube coupled to each accommodation tube to supply a second fuel into the accommodation tube; a fuel supply member supplying the first fuel accommodated in the accommodation tube into each mixing tube; wherein the accommodation tube has a fuel container combined with the second fuel tube to contain the second fuel therein, and an auxiliary injection member is disposed on the fuel container to inject the second fuel from the accommodation tube.

The auxiliary injection member may be arranged between the mixing tubes.

A mixture of air and the first fuel may be injected into the mixing tube, and only the second fuel may be injected into the auxiliary injection member.

The mixing tube may form a main flame, and the auxiliary injection member may form a fixed flame connected with the main flame to fix the main flame to the nozzle.

DETAILED DESCRIPTION

Figure 1:
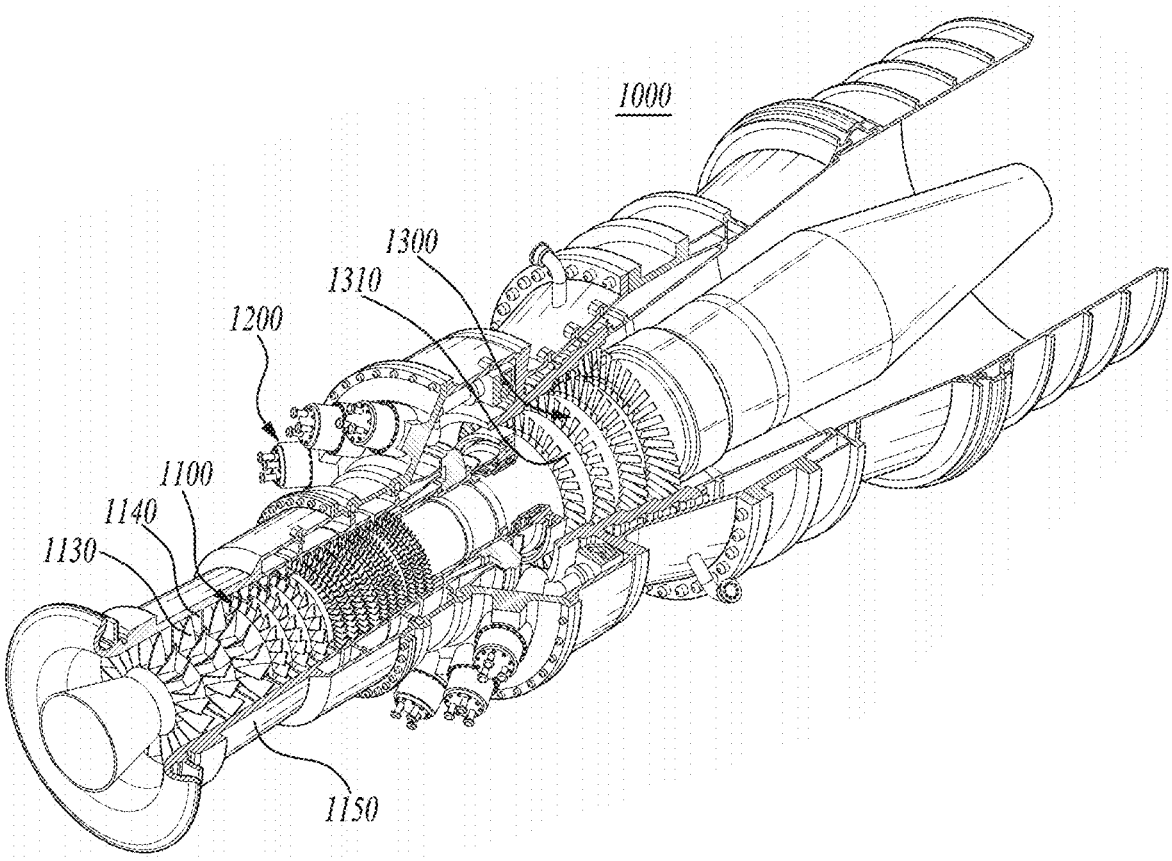
FIG. 1 is a diagram illustrating the interior of a gas turbine according to a first embodiment of the present disclosure.

Hereinafter, exemplary embodiments of the present disclosure will be described in detail with reference to the accompanying drawings. However, it should be noted that the present disclosure is not limited thereto, but may include all of modifications, equivalents or substitutions within the spirit and scope of the present disclosure.

Terms used herein are used to merely describe specific embodiments, and are not intended to limit the present disclosure. As used herein, an element expressed as a singular form includes a plurality of elements, unless the context clearly indicates otherwise. Further, it will be understood that the terms "including" or "including" specify the presence of stated features, numbers, steps, operations, elements, parts, or combinations thereof, but does not preclude the presence or addition of one or more other features, numbers, steps, operations, elements, parts, or combinations thereof. Hereinafter, preferred embodiments of the present disclosure will be described in detail with reference to the accompanying drawings.

Hereinafter, preferred embodiments of the present disclosure will be described in detail with reference to the accompanying drawings. It is noted that like elements are denoted in the drawings by like reference symbols as whenever possible. Further, the detailed description of known functions and configurations that may obscure the gist of the present disclosure will be omitted. For the same reason, some of the elements in the drawings are exaggerated, omitted, or schematically illustrated.

Hereinafter, a gas turbine according to a first embodiment of the present disclosure will be described.

Figure 2:
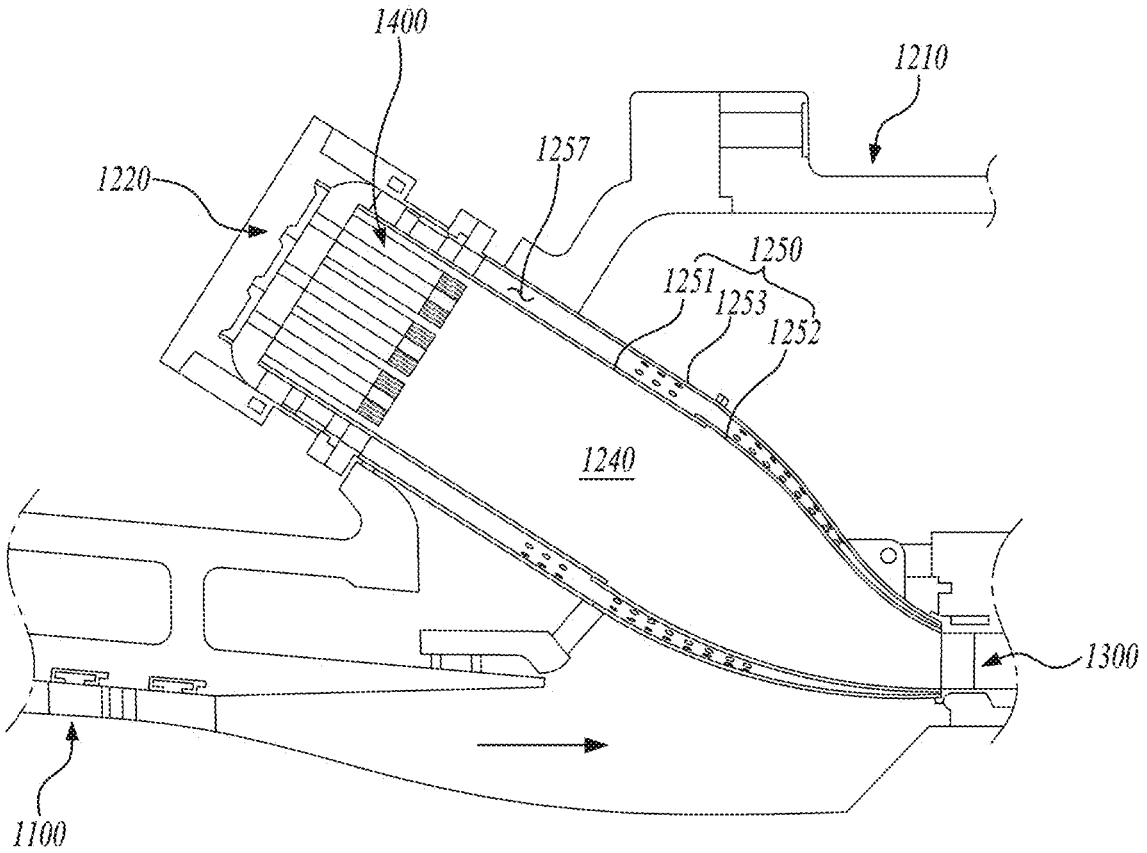
FIG. 2 is a cross-sectional diagram illustrating a combustor of FIG. 1.

FIG. 1 is a diagram illustrating the interior of a gas turbine according to a first embodiment of the present disclosure, and FIG. 2 is a cross-sectional diagram illustrating a combustor of FIG. 1.

An ideal thermodynamic cycle of a gas turbine 1000 according to the present embodiment follows a Brayton cycle. The Brayton cycle consists of four thermodynamic processes: isentropic compression (adiabatic compression), isobaric combustion, isentropic expansion (adiabatic expansion) and isobaric heat ejection. That is, in the Brayton cycle, atmospheric air is sucked and compressed into high pressure air, mixed gas of fuel and compressed air is combusted at constant pressure to discharge heat energy, heat energy of hot expanded combustion gas is converted into kinetic energy, and exhaust gases containing remaining heat energy is discharged to the outside. That is, gases undergo four thermodynamic processes: compression, heating, expansion, and heat ejection.

As illustrated in FIG. 1, the gas turbine 1000 employing the Brayton cycle includes a compressor 1100, a combustor 1200, and a turbine 1300. Although the following description will be described with reference to FIG. 1, the present disclosure may be widely applied to other turbine engines similar to the gas turbine 1000 illustrated in FIG. 1.

Referring to FIG. 1, the compressor 1100 of the gas turbine 1000 may suck and compress air. The compressor 1100 may serve both to supply the compressed air by compressor blades 1130 to a combustor 1200 and to supply the cooling air to a high temperature region of the gas turbine 1000. Here, since the sucked air undergoes an adiabatic compression process in the compressor 1100, the air passing through the compressor 1100 has increased pressure and temperature.

The compressor 1100 is usually designed as a centrifugal compressor or an axial compressor, and the centrifugal compressor is applied to a small-scale gas turbine, whereas a multi-stage axial compressor is applied to a large-scale gas turbine 1000 illustrated in FIG. 1 since the large-scale gas turbine 1000 is required to compress a large amount of air. In this case, in the multi-stage axial compressor, the compressor blades 1130 of the compressor 1100 rotate according to the rotation of the rotor disks to compress the introduced air and move the compressed air to the compressor vanes 1140 on the rear stage. As the air passes through the compressor blades 1130 formed in multiple stages, the air is compressed to a higher pressure.

The compressor vanes 1140 are mounted inside the housing 1150 in stages. The compressor vanes 1140 guide the compressed air moved from the front side compressor blades 1130 toward the rear-side compressor blades 1130. In one embodiment, at least some of the compressor vanes 1140 may be mounted so as to be rotatable within a predetermined range for adjustment of an air inflow, or the like.

The compressor 1100 may be driven using a portion of the power output from the turbine 1300. To this end, as illustrated in FIG. 1, the rotary shaft of the compressor 1100 and the rotary shaft of the turbine 1300 may be directly connected. In the case of the large-scale gas turbine 1000, almost half of the output produced by the turbine 1300 may be consumed to drive the compressor 1100. Accordingly, improving the efficiency of the compressor 1100 has a direct effect on improving the overall efficiency of the gas turbine 1000.

The turbine 1300 includes a rotor disk 1310 and a plurality of turbine blades and turbine vanes radially disposed on the rotor disk 1310. The rotor disk 1310 has a substantially disk shape on which a plurality of grooves is formed. The grooves are formed to have curved surfaces, and turbine blades and turbine vanes are inserted into the grooves. The turbine vanes are fixed against rotation and guide a flow of combustion gases through the turbine blades. The turbine blades are rotated by combustion gases to generate rotational force.

On the other hand, the combustor 1200 serves to mix the compressed air supplied from an outlet of the compressor 1100 with fuel and combust the mixture at constant pressure to produce hot combustion gases. FIG. 2 illustrates an example of the combustor 1200 provided in the gas turbine 1000. The combustor 1200 may include a combustor casing 1210, burners 1220, nozzles 1400, and a duct assembly 1250.

The combustor casing 1210 may have a substantially circular shape in which the burners 1220 are surrounded. The burners 1220 are disposed downstream of the compressor 1100 and may be disposed along the annular combustor casing 1210. Each burner 1220 is provided with a plurality of nozzles 1400, and fuel injected from the nozzles 1400 is mixed with air in an appropriate ratio to achieve a suitable state for combustion.

The gas turbine 1000 may use a gas fuel, in particular, a fuel containing hydrogen. The fuel may include a hydrogen fuel alone or a fuel containing hydrogen and natural gas.

The duct assembly 1250 is provided to connect the burners 1220 and the turbine 1300 so that the hot combustion gas flows therethrough which may heat the duct assembly, whereas the compressed air flows towards the nozzles 1400 along an outer surface of the duct assembly 1250, thereby properly cooling the heated duct assembly 1250.

The duct assembly 1250 may include a liner 1251 and a transition piece 1252, and a flow sleeve 1253. The duct assembly 1250 has a double structure in which the flow sleeve 1253 surrounds the outside of the liner 1251 and the transition piece 1252, so that compressed air penetrates into an annular space inside the flow sleeve 1253 to cool the liner 1251 and the transition piece 1252.

The liner 1251 is a tube member connected to the burners 1220 of the combustor 1200, wherein an internal space of the liner 1251 defines the combustion chamber 1240. A longitudinal one side of the liner 1251 is coupled to the burner 1220, and the other side of the liner 1251 is coupled to the transition piece 1252.

The transition piece 1252 is connected an inlet of the turbine 1300 to guide the hot combustion gas toward the turbine 1300. A longitudinal one side of the transition piece 1252 is coupled to the liner 1251, and the other side of the transition piece 1252 is coupled to the turbine 1300. The flow sleeve 1253 serves to protect the liner 1251 and the transition piece 1252 while avoiding direct exhaust of hot air to the outside.

Figure 3:
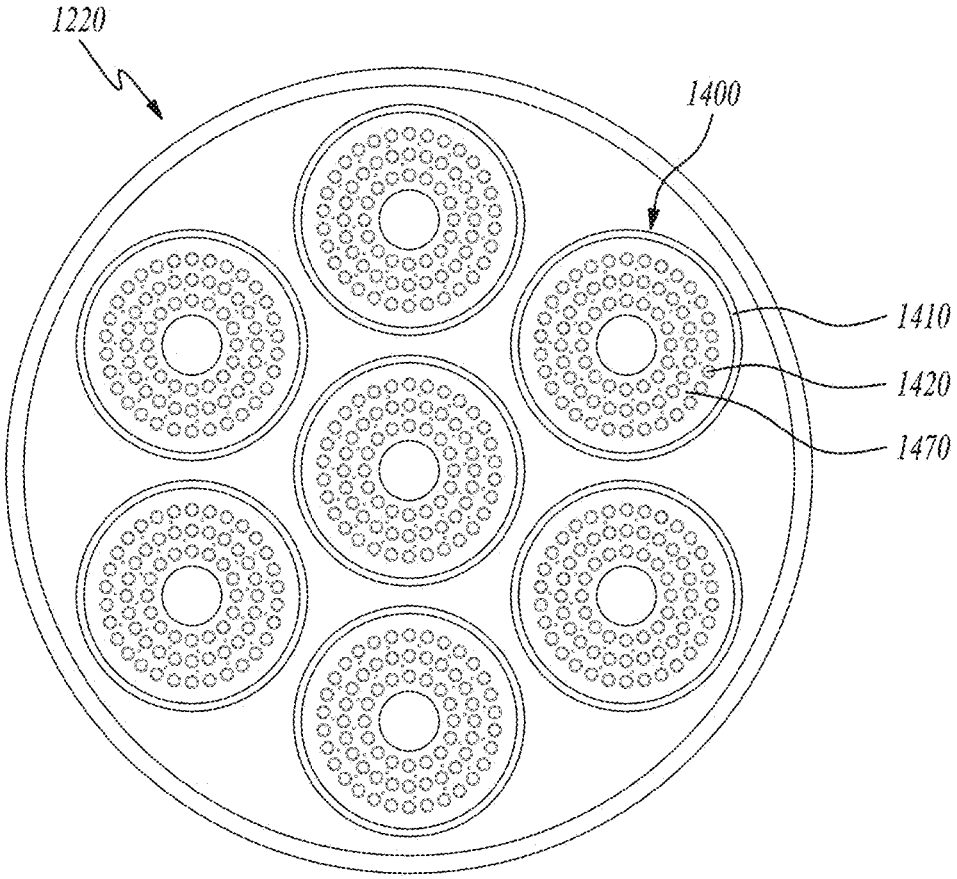
FIG. 3 is a front diagram illustrating a burner according to the first embodiment of the present disclosure.
Figure 4:
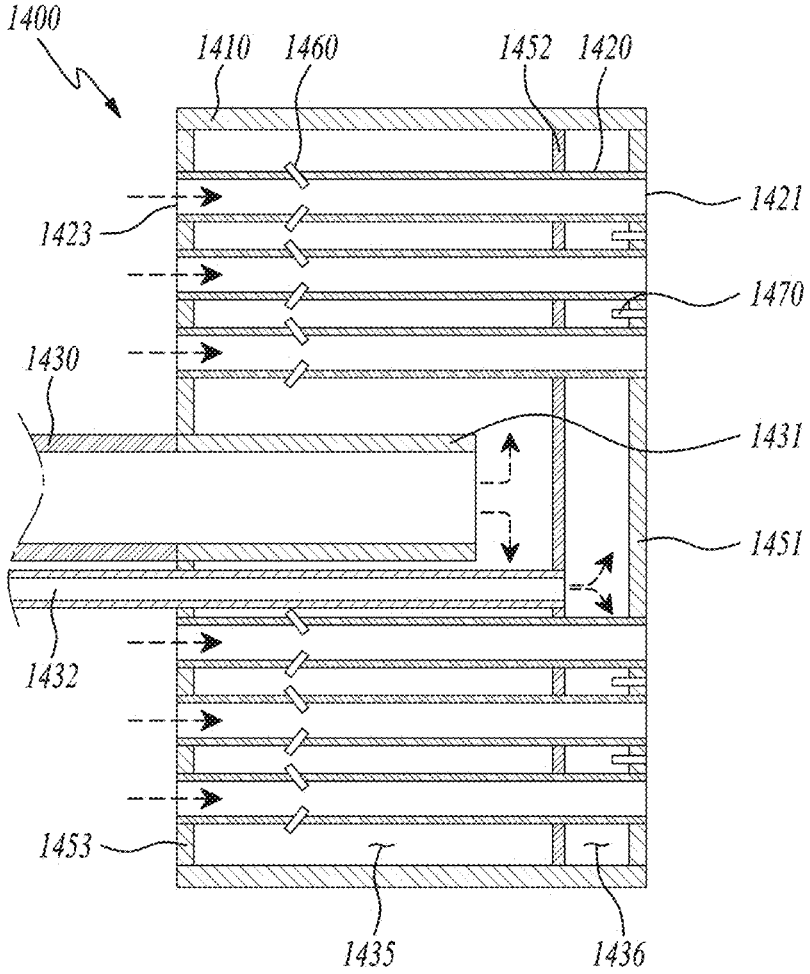
FIG. 4 is a longitudinal cross-sectional diagram illustrating a nozzle according to the first embodiment of the present disclosure.
Figure 5:
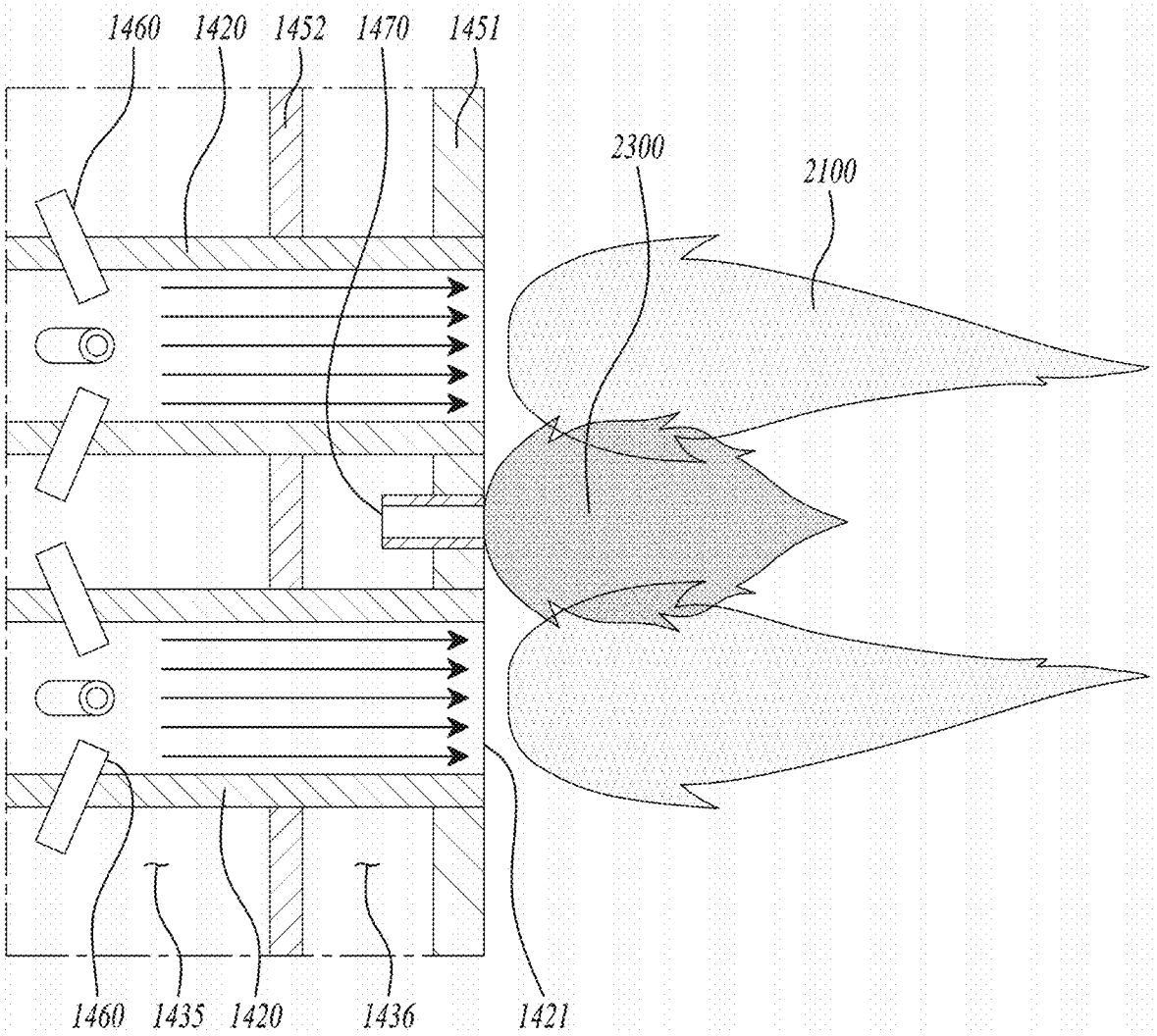
FIG. 5 is a longitudinal sectional diagram illustrating mixing tubes according to the first embodiment of the present disclosure.

FIG. 3 is a front diagram illustrating a burner according to the first embodiment of the present disclosure, FIG. 4 is a longitudinal cross-sectional diagram illustrating a nozzle according to the first embodiment of the present disclosure, and FIG. 5 is a longitudinal sectional diagram illustrating a mixing tube according to the first embodiment of the present disclosure.

Referring to FIGS. 3 to 5, the nozzle 1400 may include a plurality of mixing tubes 1420 through which air and fuel flow, a plurality of accommodation tubes 1410 each accommodating the mixing tubes 1420, first and second fuel tubes 1431 and 1432 installed inside the accommodation tube 1410, a tip plate 1451 coupled to a leading end of the accommodation tube 1410, a middle plate 1452 coupled to the interior of accommodation tube 1410, and a rear plate 1453 coupled to a rear end of the accommodation tube 1410.

The accommodation tube 1410 is cylindrical in shape, with a cavity formed therein. The nozzle 1400 may further include a fuel supply tube 1430 that supplies a first fuel to the accommodation tube 1410. Here, the first fuel may include a hydrogen-based fuel having hydrogen as a major component or a hydrocarbon-based fuel having hydrocarbon as a major component. The first fuel may also include a mixture of a hydrogen-based fuel and a hydrocarbon-based fuel.

As used herein, the hydrogen-based fuel means a fuel having a concentration of at least 70 wt % hydrogen, and the hydrocarbon-based fuel means a fuel having a concentration of at least 70 wt % hydrocarbon. The hydrocarbon-based fuel may include natural gas or the like.

The first fuel tube 1431 is disposed at the radial center of the accommodation tube 1410 to provide a space for the first fuel to flow. A first longitudinal end of the first fuel tube 1431 is connected to the fuel supply tube 1430 to receive fuel, and a second longitudinal end of the first fuel tube 1431 is connected to a distribution space 1435 defined in the accommodation tube 1410 to supply fuel to the distribution space 1435.

The tip plate 1451 is coupled to the leading end of the accommodation tube 1410 to define a fuel container 1438. Leading ends of the mixing tubes 1420 are inserted into the tip plate 1451.

The middle plate 1452 is spaced from the tip plate 1451 toward the rear (toward upstream side) of the accommodation tube 1410 and coupled to the accommodation tube 1410. The fuel container 1436 is defined between the middle plate 1452 and the tip plate 1451, and fuel supplied from the second fuel tube 1432 may be contained in the fuel container 1436. The middle plate 1452 may be positioned further forward (downstream) than the longitudinal center of the accommodation tube 1410.

The rear plate 1453 is secured to the rear end (upstream side) of the accommodation tube 1410 to define a distribution space 1435 with the middle plate 1452. The distribution space 1435 has a greater volume than the fuel container 1436.

The second fuel tube 1432 is radially spaced apart from the first fuel tube 1431 and is connected to the fuel container 1436 to supply a second fuel to the fuel container 1436. Here, the second fuel may include a hydrocarbon-based fuel having hydrocarbon as a major component, in particular natural gas.

Each mixing tube 1420 is formed to extend through the rear plate 1453, the middle plate 1452, and the tip plate 1451. At the leading end of the mixing tube 1420, an outlet 1421 may be formed for fuel and air to exit, and at the trailing end of the mixing tube 1420, an inlet 1423 may be formed for air to enter.

The plurality of mixing tubes 1420 are distributed inside the accommodation tube 1410 to accommodate and mix fuel and air and inject the fuel-air mixture into the combustion space. The mixing tube 1420 is formed with a circular tube with a relatively small diameter to allow the fuel and air to be injected at high speed.

A fuel supply member 1460 may be disposed on the mixing tube 1420 to supply a first fuel into the mixing tube 1420. The fuel supply member 1460 is connected with the distribution space 1435 to inject the first fuel from the distribution space 1435 into the mixing tube 1420.

The fuel supply member 1460 may be tubular in shape and may slope forward (downstream) with respect to a radial direction of the mixing tube 1420 and protrude into the mixing tube 1420. The plurality of fuel supply members 1460 may be circumferentially disposed on the mixing tube 1420 so as to be spaced apart from each other.

An auxiliary injection member 1470 may be disposed on the fuel container 1436 to inject the second fuel to the outside of the accommodation tube 1410. A plurality of auxiliary injection members 1470 may be installed on the accommodation tube 1410, and the auxiliary injection members 1470 may be tubular in shape.

The auxiliary injection members 1470 may be positioned between the mixing tubes 1420 so as to extend through the tip plate 1451. In addition, the auxiliary injection member 1470 is connected to the fuel container 1436 to inject only the second fuel without air toward the front side of the accommodation tube 1410.

As illustrated in FIG. 5, a main flame 2100 is formed by the air and first fuel injected from the mixing tube 1420, and a fixed flame 2300 is formed by the second fuel injected from the auxiliary injection member 1470.

If the first fuel is a hydrocarbon-based fuel such as natural gas, the main flame 2100 may be delaminated at the outlet end of the mixing tube 1420 due to its slower combustion rate compared to hydrogen. However, the auxiliary injection member 1470 slowly injects a second fuel with a higher fuel concentration so that the fixed flame 2300 may be formed by the second fuel, and the fixed flame 2300 may fix the main flame 2100 to the nozzle to prevent flame blowout and maintain a stable flame.

One auxiliary injection member 1470 may form the fixed flame 2300 connected to the plurality of main flames 2100 to fix the plurality of main flames 2100. That is, one fixed flame 2300 may be connected with the plurality of main flames 2100. Further, one main flame 2100 may be connected with one or more fixed flames 2300.

The first fuel may include hydrogen, natural gas, or a mixture of hydrogen and natural gas. If the first fuel is hydrogen, the second fuel may not be supplied through the auxiliary injection member 1470 because the flame may remain stable even when the second fuel is not supplied. However, if the first fuel is a mixture of hydrogen and natural gas or a natural gas fuel, the second fuel needs to be supplied through the auxiliary injection member 1470 to maintain a stable flame.

Figure 6A:
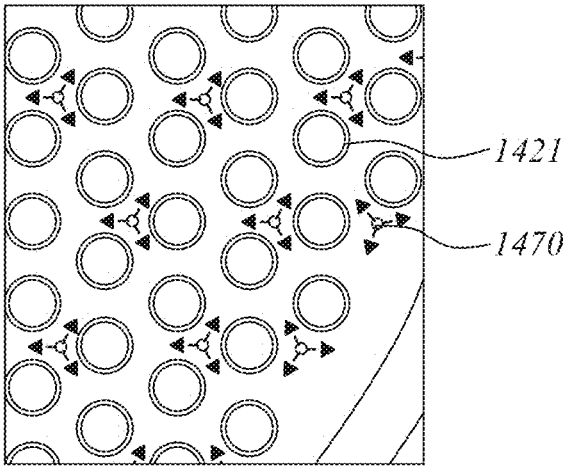
FIG. 6A is a diagram illustrating a portion of a nozzle according to a first embodiment of the present disclosure.
Figure 6B:
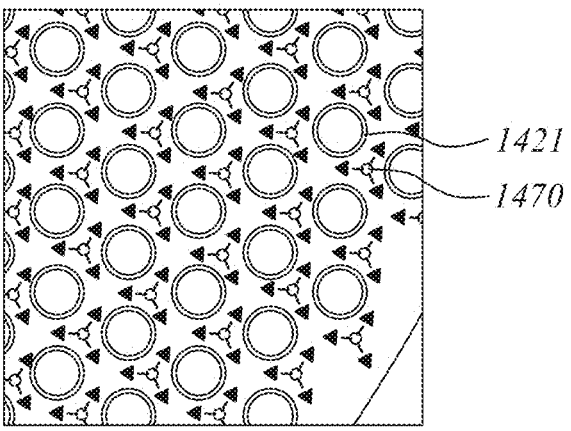
FIG. 6B is a diagram illustrating a portion of a nozzle according to a first variant of the first embodiment of the present disclosure.
Figure 6C:
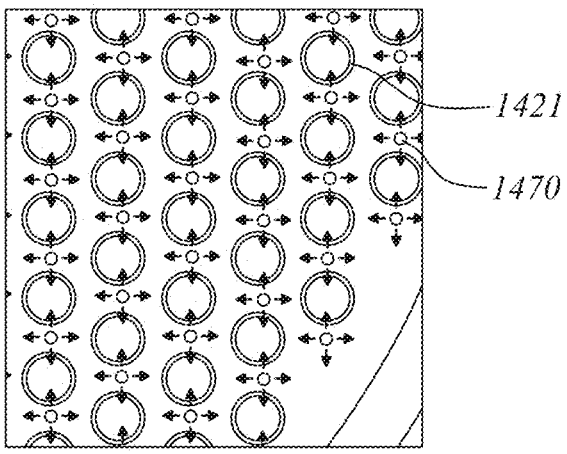
FIG. 6C is a diagram illustrating a portion of a nozzle according to a second variant of the first embodiment of the present disclosure.

As illustrated in FIGS. 6A to 6C, the auxiliary injection member 1470 may be disposed in various configurations between the plurality of mixing tubes 1420. For example, as illustrated in FIG. 6A, one auxiliary injection member 1470 may be disposed between three mixing tubes 1420 such that the main flame 2100 formed by one mixing tube 1420 is connected to a single fixed flame 2300.

Also, as illustrated in FIG. 6B, one auxiliary injection member 1470 may be disposed between the three mixing tubes 1420 such that the main flame 2100 formed by one mixing tube 1420 is connected to a plurality of fixed flames 2300.

Further, as illustrated in FIG. 6C, one auxiliary injection member 1470 may be disposed between the two mixing tubes 1420 such that the main flame 2100 formed by the one mixing tube 1420 is connected to a plurality of fixed flames 2300.

However, the present disclosure is not limited thereto, and the auxiliary injection member 1470 may be arranged in various configurations.

As described above, the present embodiment enables mixing and combustion of hydrocarbon-based fuel such as natural gas in the nozzle designed for combustion of hydrogen, and the flame is maintained by the second fuel regardless of the flow rate of the first fuel, so that the flow rate of the first fuel may be controlled to easily control occurrence of vibration and generation of carbon monoxide and nitrogen oxide.

Hereinafter, a nozzle according to a second embodiment of the present disclosure will be described.

Figure 7:
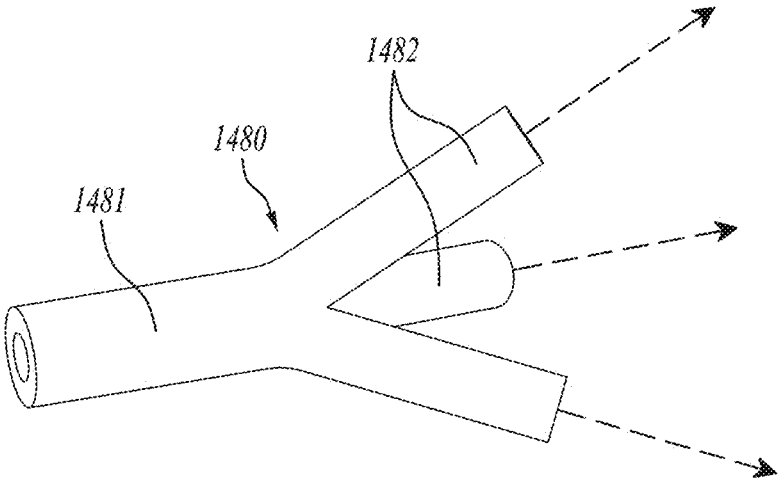
FIG. 7 is a perspective diagram illustrating an auxiliary injection member according to a second embodiment of the present disclosure.

FIG. 7 is a longitudinal sectional diagram illustrating an auxiliary injection member according to a second embodiment of the present disclosure.

Referring to FIG. 7, the nozzle according to the second embodiment has the same structure as the nozzle according to the first embodiment described above, except for an auxiliary injection member 1480, so a repeated description of the same configuration will be omitted.

The auxiliary injection member 1480 may be disposed on the accommodation tube to inject the second fuel into the front side of the accommodation tube. The auxiliary injection member 1480 may be tubular in shape and may include a central injection tube part 1481 and a plurality of inclined injection tube parts 1482 connected to the central injection tube part 1481. The central injection tube part 1481 may extend longitudinally through the accommodation tube 1410, and the inclined injection tube parts 1482 may extend inclined to the central injection tube part 1481. The plurality of inclined injection tube parts 1482 may be formed radially symmetrically from the central injection tube part 1481. Three inclined injection tube parts 1482 may be connected to one central injection tube part 1481. However, the present disclosure is not limited thereto, and two or four inclined injection tube parts 1482 may be connected to one central injection tube part 1481.

As noted above, according to the second embodiment, the auxiliary injection member 1480 includes the plurality of inclined injection tube parts 1482 so that a fixed flame may be formed wide enough to reliably support a plurality of main flames. Depending on the combustion situation, the shape and size of the main flame may vary, and the wider the auxiliary flame is formed, the more reliably the main flame is supported.

The following describes a nozzle according to a third embodiment of the present disclosure.

Figure 8:
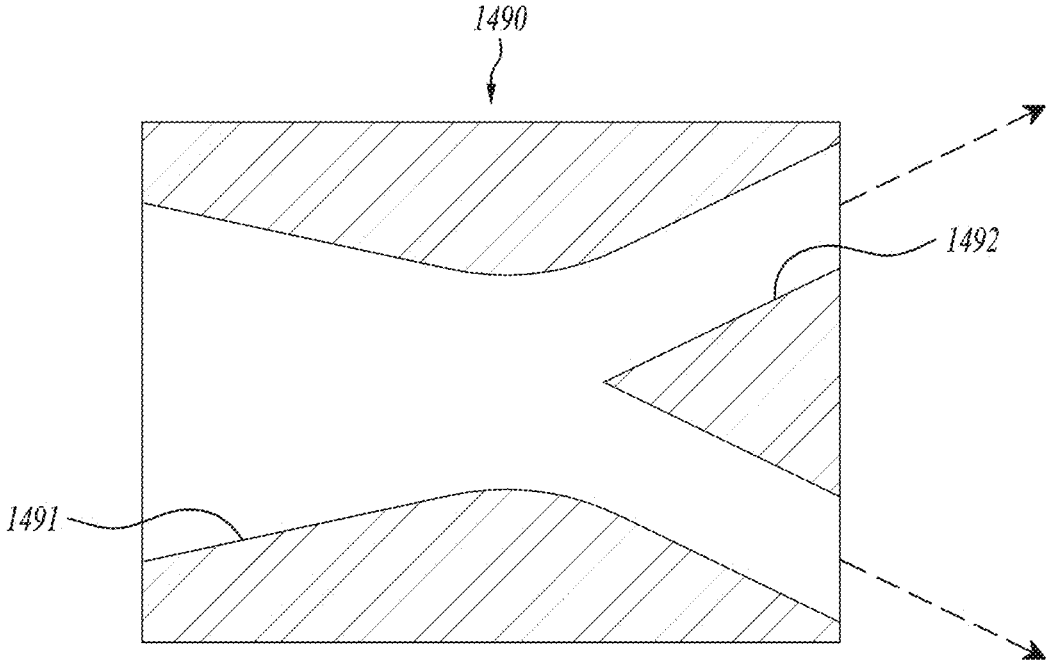
FIG. 8 is a longitudinal sectional diagram illustrating an auxiliary injection member according to a third embodiment of the present disclosure.
Figure 9:
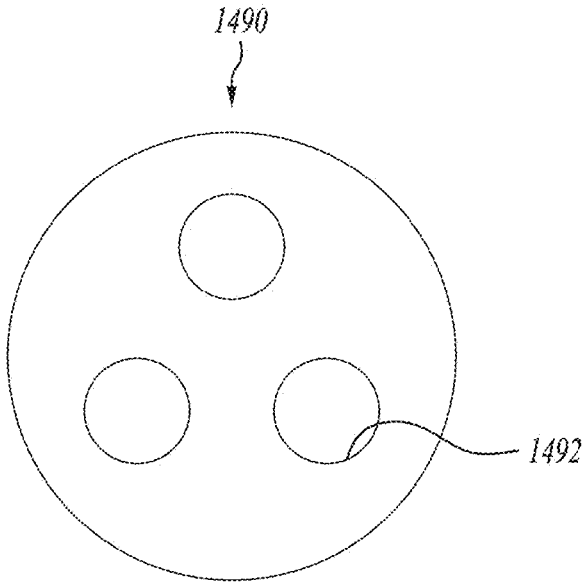
FIG. 9 is a front diagram illustrating an auxiliary injection member according to the third embodiment of the present disclosure.

FIG. 8 is a longitudinal sectional diagram illustrating an auxiliary injection member according to a third embodiment of the present disclosure, and FIG. 9 is a front diagram illustrating an auxiliary injection member according to the third embodiment of the present disclosure.

Referring to FIGS. 8 and 9, the nozzle according to the third embodiment has the same structure as the nozzle according to the first embodiment described above, except for an auxiliary injection member 1490, so a repeated description of the same configuration will be omitted.

The auxiliary injection member 1490 may be disposed on the accommodation tube to inject the second fuel toward the front side of the accommodation tube. The auxiliary injection member 1490 may be a cylindrical tube internally provided with a central passage 1491 and a plurality of discharge passages 1492 connected to the central passage 1491. The central passage 1491 may extend longitudinally through the auxiliary injection member 1490 so that the central passage has a gradually decreasing inner diameter toward the outlet side.

The discharge passages 1492 may extend inclined to the longitudinal direction of the central passage 1491 and may have a uniform inner diameter. The plurality of discharge passages 1492 may extend radially symmetrically from the central passage 1491. Three discharge passages 1492 may be connected to a single central passage 1491. However, the present disclosure is not limited thereto, and two or four discharge passages 1492 may be connected to a single central passage 1491.

As noted above, according to the third embodiment, the auxiliary injection member 1490 is formed with the central passage 1491 and the plurality of discharge passages 1492, so that a fixed flame may be formed wide enough to reliably support a plurality of main flames.

While the embodiments of the present disclosure have been described, it will be apparent to those skilled in the art that various modifications and variations can be made in the present disclosure through addition, change, omission, or substitution of components without departing from the spirit of the disclosure as set forth in the appended claims, and such modifications and changes may also be included within the scope of the present disclosure.

The invention claimed is:

1. A combustor nozzle comprising:

a plurality of mixing tubes through which air and fuel flow;

a plurality of accommodation tubes each accommodating and supporting the plurality of mixing tubes therein;

a first fuel tube coupled to each accommodation tube to supply a first fuel into the accommodation tube;

a second fuel tube coupled to each accommodation tube to supply a second fuel into the accommodation tube; and a fuel supply member supplying the first fuel accommodated in the accommodation tube into each mixing tube, wherein the accommodation tube has a fuel container combined with the second fuel tube to contain the second fuel therein, and an auxiliary injection member is disposed on the fuel container to inject the second fuel from the accommodation tube.

2. The combustor nozzle of claim 1, wherein the auxiliary injection member is arranged between the mixing tubes.

3. The combustor nozzle of claim 1, wherein a mixture of air and the first fuel is injected into the mixing tube, and only the second fuel is injected into the auxiliary injection member.

4. The combustor nozzle of claim 1, wherein the mixing tube forms a main flame, and the auxiliary injection member forms a fixed flame connected with the main flame to fix the main flame to the nozzle.

5. The combustor nozzle of claim 4, wherein the auxiliary injection member forms a fixed flame connected with the plurality of main flames to fix the main flames.

6. The combustor nozzle of claim 1, wherein the accommodation tube comprises: a tip plate formed on the front side thereof; and a middle plate spaced apart from the tip plate to define a fuel container, wherein the second fuel tube is inserted into the middle plate.

7. The combustor nozzle of claim 1, wherein the auxiliary injection member comprises: a central injection tube part extending in the longitudinal direction of the accommodation tube; and a plurality of inclined injection tube parts connected to the central injection tube part to extend radially symmetrically from the central injection tube part.

8. The combustor nozzle of claim 1, wherein the auxiliary injection member is internally provided with a central passage and a plurality of discharge passages connected to the central passage to extend inclined to the longitudinal direction of the central passage.

9. A combustor comprising:

a burner having a plurality of nozzles through which fuel and air are injected; and a duct assembly coupled to one side of the burner to allow the fuel and the air to be combusted therein and combustion gases to be transferred to a turbine, wherein the nozzle comprises:

a plurality of mixing tubes through which air and fuel flow;

a plurality of accommodation tubes each accommodating and supporting the plurality of mixing tubes therein;

a first fuel tube coupled to each accommodation tube to supply a first fuel into the accommodation tube;

a second fuel tube coupled to each accommodation tube to supply a second fuel into the accommodation tube; and a fuel supply member supplying the first fuel accommodated in the accommodation tube into each mixing tube, wherein the accommodation tube has a fuel container combined with the second fuel tube to contain the second fuel therein, and an auxiliary injection member is disposed on the fuel container to inject the second fuel from the accommodation tube.

10. The combustor of claim 9, wherein the auxiliary injection member is arranged between the mixing tubes.

11. The combustor of claim 9, wherein a mixture of air and the first fuel is injected into the mixing tube, and only the second fuel is injected into the auxiliary injection member.

12. The combustor of claim 9, wherein the mixing tube forms a main flame, and the auxiliary injection member forms a fixed flame connected with the main flame to fix the main flame to the nozzle.

13. The combustor of claim 12, wherein the auxiliary injection member forms a fixed flame connected with the plurality of main flames to fix the main flames.

14. The combustor of claim 9, wherein the accommodation tube comprises: a tip plate formed on the front side thereof; and a middle plate spaced apart from the tip plate to define a fuel container, wherein the second fuel tube is inserted into the middle plate.

15. The combustor of claim 9, wherein the auxiliary injection member comprises: a central injection tube part extending in the longitudinal direction of the accommodation tube; and a plurality of inclined injection tube parts connected to the central injection tube part to extend radially symmetrically from the central injection tube part.

16. The combustor of claim 9, wherein the auxiliary injection member is internally provided with a central passage and a plurality of discharge passages connected to the central passage to extend inclined to the longitudinal direction of the central passage.

17. A gas turbine comprising:

a compressor compressing an externally introduced air;

a combustor mixing the compressed air from the compressor with fuel to produce a mixture and combusting the mixture; and a turbine having a plurality of turbine blades rotated by the combustion gases from the combustor, wherein the combustor comprises:

a burner having a plurality of nozzles through which fuel and air are injected; and a duct assembly coupled to one side of the burner to allow the fuel and the air to be combusted therein and combustion gases to be transferred to a turbine, wherein the nozzle comprises:

a plurality of mixing tubes through which air and fuel flow;

a plurality of accommodation tubes each accommodating and supporting the plurality of mixing tubes therein;

a first fuel tube coupled to each accommodation tube to supply a first fuel into the accommodation tube;

a second fuel tube coupled to each accommodation tube to supply a second fuel into the accommodation tube; and a fuel supply member supplying the first fuel accommodated in the accommodation tube into each mixing tube, wherein the accommodation tube has a fuel container combined with the second fuel tube to contain the second fuel therein, and an auxiliary injection member is disposed on the fuel container to inject the second fuel from the accommodation tube.

18. The gas turbine of claim 17, wherein the auxiliary injection member is arranged between the mixing tubes.

19. The gas turbine of claim 17, wherein a mixture of air and the first fuel is injected into the mixing tube, and only the second fuel is injected into the auxiliary injection member.

20. The gas turbine of claim 17, wherein the mixing tube forms a main flame, and the auxiliary injection member forms a fixed flame connected with the main flame to fix the main flame to the nozzle.

* * * * *